United States Patent [19]

Schroeder et al.

[11] 4,266,470

[45] May 12, 1981

[54] UNIVERSAL AIR DIFFUSER

[75] Inventors: Clifford A. Schroeder, Westlake; Ralph L. Fogg, Chatsworth; Harry J. Farason, West Covina; Robert E. Voorhees, Van Nuys, all of Calif.

[73] Assignee: C. A. Schroeder Inc., San Fernando, Calif.

[21] Appl. No.: 87,916

[22] Filed: Oct. 24, 1979

[51] Int. Cl.[3] ..... F24F 7/00

[52] U.S. Cl. ..... 98/40 R; 98/40 D; 98/40 VM; 98/DIG. 10

[58] Field of Search ..... 98/40 R, 40 D, 40 VM, 98/DIG. 10; 181/224, 291, 294, 208, 209; 156/212, 213; 428/251, 252; 285/55, 158, 423, 293

[56] References Cited

U.S. PATENT DOCUMENTS

| | | | |
|---|---|---|---|
| 2,050,023 | 8/1936 | Slayter | 285/293 |
| 2,861,510 | 11/1958 | Wulle | 98/40 D |
| 2,900,182 | 8/1959 | Hinks | 181/208 |
| 3,276,928 | 10/1966 | Pearson et al. | 181/291 X |
| 4,040,213 | 8/1977 | Capaul | 181/291 X |
| 4,159,674 | 7/1979 | Brumlev, Jr. | 98/40 R |

*Primary Examiner*—Albert J. Makay
*Assistant Examiner*—Harold Joyce
*Attorney, Agent, or Firm*—David O'Reilly; Donald M. Cislo

[57] ABSTRACT

A universal air diffuser comprised of a fiberglass plenum having an open side and means for attaching a duct connector on a closed side opposite the open side. The closed side of the fiberglass plenum is covered with a close-fitting non-porous material which reinforces the fiberglass to allow cutting holes for attachment of air ducts. A plurality of shallow grooves on the exterior of the closed surface provide cutting lines for hole patterns to cut holes for various standard size ducts. The reinforcing material is a fiberglass-reinforced foil which maintains the integrity of the hole cut in the surface and provides a non-porous surface for adhering to duct tape.

8 Claims, 5 Drawing Figures

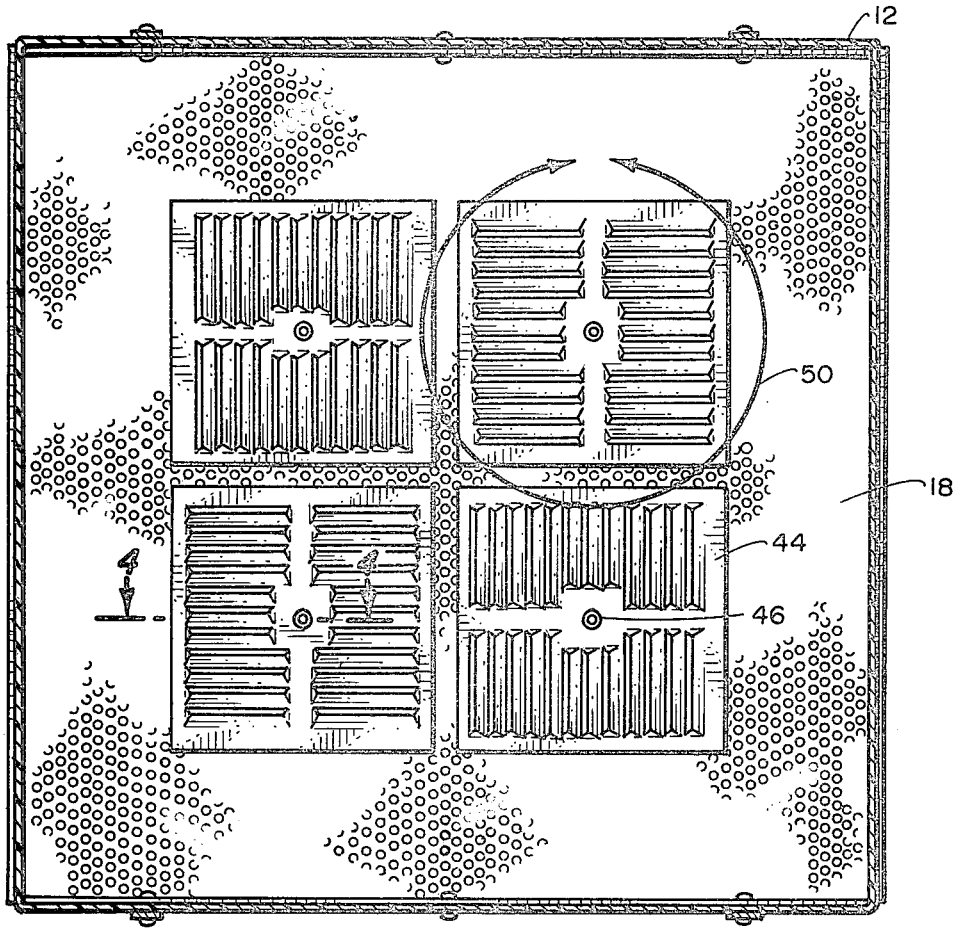
Fig. 3.
Fig. 4.
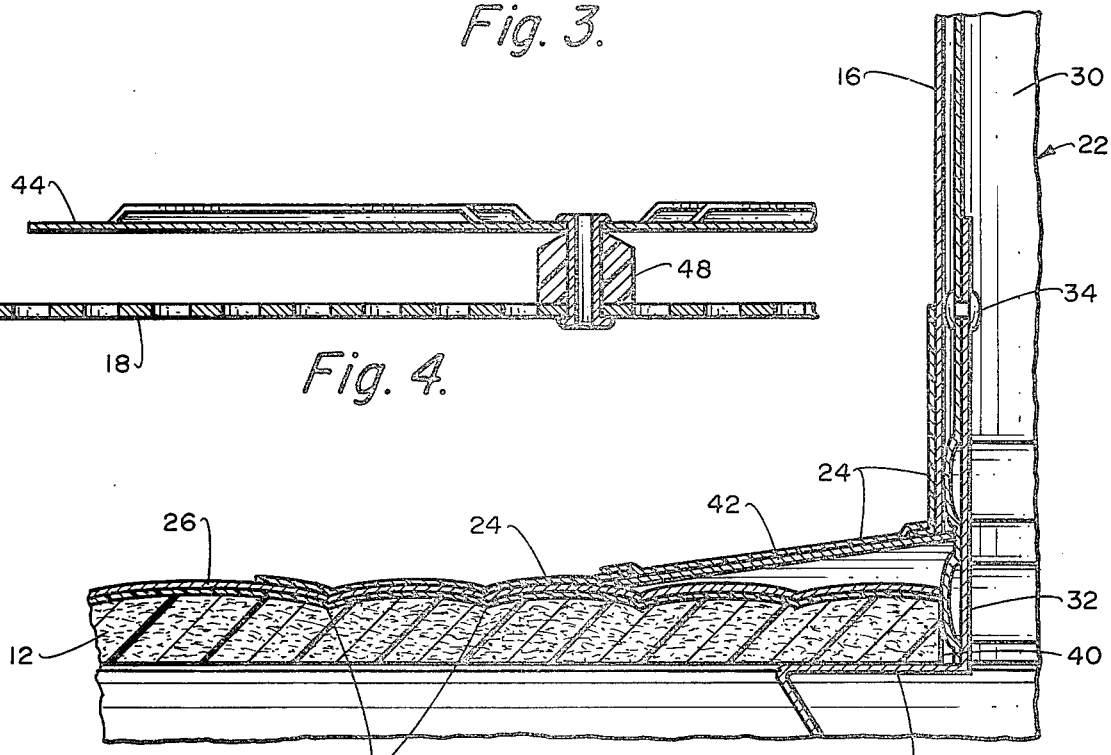
Fig. 5.

UNIVERSAL AIR DIFFUSER

BACKGROUND OF THE INVENTION

This invention relates to air diffusers and more particularly relates to the universal air diffuser having an improved construction.

Air diffusers are devices comprised of a plenum, usually mounted in the ceiling for dispersing air delivered through ducts of a heating or cooling system. The plenum is provided with a perforated face fitting flush with the ceiling for dispersing air throughout an area or room and includes means for attaching an air duct on the opposite side. The air ducts are attached by cutting a hole in the plenum and inserting a duct connector having flanges resting on the surface of the plenum to which the duct is secured by means of duct tape. The plenum is constructed of compacted fiberglass which is somewhat porous. Because of this, the tape used to secure the duct to the plenum does not adhere at all. Further, the hole cut in the plenum for attaching the duct does not stand up well under repeated use. Removal of the duct connector can easily tear or otherwise scar the mounting hole, preventing reuse of the diffuser. It would be advantageous if some method could be provided to reinforce the plenum and also provide a non-porous surface to which duct tape will stick securely.

SUMMARY OF THE INVENTION

The purpose of the present invention is to provide an air diffuser in which the connecting hole for air ducts can be kept intact through repeated use while also providing a non-porous surface for adhering to duct tape.

The air diffuser of the present invention is comprised of a plenum or casing open on one side and closed on the other. The open side has a perforated face including adjustable louvers for diffusing air delivered to the plenum. The closed side is covered with a reinforcing material which maintains holes cut in the plenum intact, while simultaneously providing a non-porous surface to stick securely to duct tape. The closed side also includes hole patterns comprised of shallow concentric channels which provide cut lines for indicating hole sizes for standard ducts.

The perforated face attached to the open side also includes a plurality of adjustable louvers to divert air in a preselected pattern. The louvers are secured to the perforated face and include resilient spacers to prevent unintentional movement of the louvers. The resilient spacer also damps any vibrations of the louvers or perforated face.

It is one object of the present invention to provide a universal air diffuser having a reinforced plenum.

Still another object of the present invention is to provide a universal air diffuser having a fiberglass plenum and a surface to which duct tape will securely adhere for sealing air purposes.

Still another object of the present invention is to provide a universal air diffuser having a plenum which maintains connecting holes intact during repeated use.

These and other objects of the invention will become apparent from the following detailed description of the invention when considered in conjunction with the accompanying drawings wherein like reference numbers identify like parts throughout.

BRIEF DESCRIPTION OF THE DRAWINGS

FIG. 3 is a sectional view of the universal air diffuser taken at 3—3 of FIG. 1.

FIG. 4 is a sectional view taken at 4—4 of FIG. 3.

FIG. 5 is a partial sectional view of the air diffuser illustrating in detail the construction and assembly.

DETAILED DESCRIPTION OF THE PREFERRED EMBODIMENT

Figure 1:
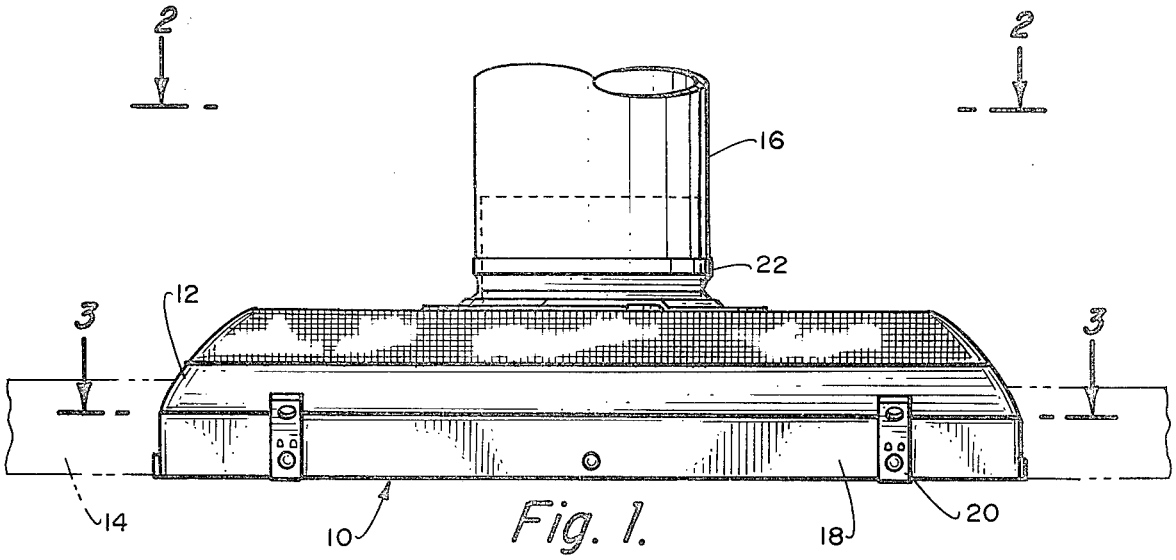
FIG. 1 is a side elevation of a universal air diffuser according to the invention.

A universal air diffuser is illustrated in FIG. 1 at 10 and is comprised of a plenum 12 secured in a structural mounting surface 14, such as a ceiling and connected to a duct 16. A perforated face 18 is attached to the open side of plenum 12 for diffusing air from a forced air heating or cooling system. Sheet metal strips 20 are provided for securing the air diffuser to the structural surface 14.

The plenum 12 is constructed of a preformed compacted fiberglass material which is semi-porous. The forced air duct 16 is attached to the plenum 12 by means of a duct connector 22 secured to the plenum by means of duct tape 24 and/or spring clips attached to the collar. Because the fiberglass material forming the plenum 12, though compact is still somewhat porous, duct tape 24, after short periods of use, frequently separates, allowing the duct to separate from the air diffuser because the tape will not stick to raw fiberglass surface. This can cause a loss of air being delivered to the air diffuser.

Additionally, the hole cut through the plenum 12 for installing the duct connector 22 is not very strong and can quickly become unusable by scarring, ripping and splitting when the duct connector is removed and replaced.

To avoid these problems and provide a non-porous surface to which the duct tape 24 will securely adhere, a reinforcing material 26 is securely bonded to the exterior surface of the plenum 12. Preferably the non-porous material is a fiberglass-reinforced foil composition which can be stretched tightly over the surface of the plenum 12 and bonded by using an adhesive, pressure and heat. The reinforcing material sometimes called foil "scrim" is comprised of a gauze-like fiberglass sandwiched between the sheets of foil, foil paper or foil plastic. The "scrim" provides a strong, reinforcing, non-porous cover for the plenum 12 to which the duct tape securely sticks and also keeps the edges of holes cut into the plenum intact during repeated use.

Figure 2:
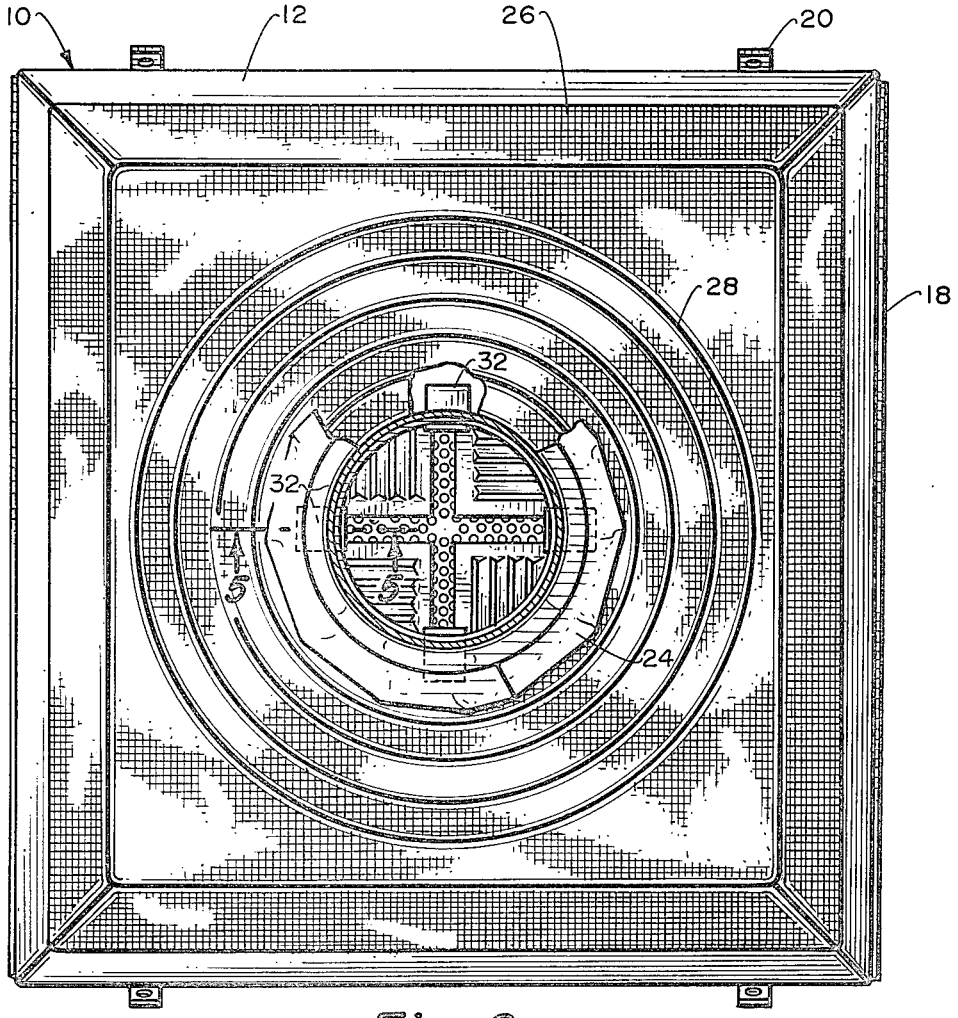
FIG. 2 is a top view of the universal air diffuser taken at 2—2 of FIG. 1.

The plenum or casing 12 is also formed with a plurality of concentric shallow grooves 28, providing hole patterns for cutting the plenum 12 for installation of duct work. The hole pattern provided by the shallow channels 28 provides a cutting line for a particular size of duct in use. Thus, to install the air diffuser the size of duct 16 to be used is determined and the appropriate channel or line 28 in the plenum 12 is used to cut the hole size for installation of a duct connector 22. Usually the duct connector 22 is in the form of a short length of duct having a plurality of slots on one end providing tabs for resting against the surface of the plenum 12, while alternate tabs fit the hole cut along the hole pattern lines or channels 28. The periphery of the duct connector 22 is then sealed with duct tape 24 as illustrated in FIGS. 2 and 5.

An alternate method of installing the air diffuser is with a snap-in duct connector which is a unique feature of the present invention. In this embodiment the duct connector 22 has an integral collar 42 (FIG. 5) and can be used with or without the duct tape 24. This detail of this embodiment is shown in the partial sectional view of FIG. 5. The duct connector 22 is comprised of a short piece of duct 30 having a plurality of sheet metal snap-in tabs 32 riveted as shown at 34 to the duct 30. Generally four, equally-spaced tabs 32 are sufficient. The tabs 32 are bent as shown at 36 to provide a detent to snap-lock into the periphery of hole 40 in the plenum 12. A collar 42 attached to the periphery of the duct 30 bears on the upper surface of the plenum 12 locking the duct connector 22 into the hole 40 cut in the plenum. Successive layers of duct tape 24 can be provided around the periphery of the collar 42 to seal the connector 22, if desired. Usually, however, it is unnecessary as the pressure of the edge of the collar 42 against the external surface of the plenum 12 is sufficient to seal the duct connector 22. As can be seen, this type of construction for the duct connector 22 allows easy separation of the diffuser and duct connector for replacement or repairs.

The perforated face 18 attached to the plenum 12 includes a plurality of adjustable louvers 44 secured by means of rivets 46 providing a spindle on which they can be adjustably rotated to diffuse air delivered through duct 16. In order to reduce vibrations and prevent unintentional movement of the louvers 44, a resilient spacer 48 is provided around the spindle or rivet 46 securing the louver 44 to the perforated face 18. The louver 44 has a plurality of slots for deflecting air passing through the plenum in the direction desired. The louvers 44 are adjusted by rotating to the position desired as illustrated by the arrow 50.

The method of constructing the air diffuser is as follows. The plenum 12 is first formed having an open side and a closed side, with the shallow channels 28 incorporated to provide a hole pattern. The reinforcing material or scrim 26 is then stretched over the closed surface of the plenum and bonded by an adhesive pressure and heat, if desired. The particular line or channel 28 for the desired duct size is then used to cut a hole through the plenum 12. The duct connector 22 is then secured by simply inserting and securing with duct tape 24 or the snap-in type duct connector 22, as shown in FIG. 5 is employed. The perforated face 18 with the adjustable louvers 44 is then secured to the open side of the plenum 12. Alternately, the hole in the plenum 12 can be cut at the installation site which is usually the case.

Obviously, many modifications and variations of the invention are possible in light of the above teachings. It is therefore to be understood that the full scope of the invention is not limited to the details disclosed herein and may be practiced otherwise than as specifically described.

What is claimed is:

1. A method of forming an air diffusing apparatus for connection to an air delivery system comprising:

forming a plenum of densely compacted, somewhat porous fiberglass material having one side open;

covering a substantial portion of the exterior surface of the closed side of said plenum with a thin layer of non-porous material;

securely bonding said non-porous material to said exterior surface with an adhesive;

cutting a hole through the closed side of said plenum and said non-porous material to match the duct size of said air delivery system;

inserting a duct connector into said hole;

securing said duct connector to the non-porous covering of said plenum with an adhesive tape;

whereby said duct connector will remain secured to said plenum.

2. A method according to claim 1 wherein the steps of covering and securing the non-porous material to said plenum include:

stretching said non-porous material tightly over said exterior surface;

applying heat to said non-porous material during the bonding so that said non-porous material is uniformly bonded to said exterior surface.

3. A method according to claim 2 in which the step of covering the exterior surface with a non-porous material comprises covering the exterior surface with a fiberglass reinforced metal foil.

4. A method according to claim 1 wherein the step of securing the connector duct comprises:

forming a collar around the periphery of said duct connector;

forming a plurality of deflectable tabs around the end of said duct connector which is inserted in said hole;

said deflectable tabs having a detent adapted to snap over the edge of said hole and press against the interior surface of said fiberglass plenum.

5. The method according to claim 1 including attaching a perforated face to the open side of said fiberglass enclosure.

6. A method according to claim 5 including attaching a plurality of adjustable louvers to said perforated face.

7. A method according to claim 6 wherein the step of attaching the louvers comprises:

riveting said louvers at the center to said perforated face so that the louvers may rotate for adjustment.

8. A method according to claim 7 including inserting a resilient spacer around said rivet between said louver and said perforated face.

* * * * *